United States Patent [19]

Fischer et al.

[11] Patent Number: 4,676,887

[45] Date of Patent: Jun. 30, 1987

[54] PRODUCTION OF HIGH OCTANE GASOLINE

[75] Inventors: Ronald H. Fischer, Cherry Hill; Yun-Yang Huang, Voorhees; Rene B. LaPierre, Medford; Philip Varghese, Voorhees, all of N.J.

[73] Assignee: Mobil Oil Corporation, New York, N.Y.

[21] Appl. No.: 825,294

[22] Filed: Feb. 3, 1986

Related U.S. Application Data

[63] Continuation-in-part of Ser. No. 740,677, Jun. 3, 1985, abandoned.

[51] Int. Cl.[4] ..... C10G 65/12

[52] U.S. Cl. ..... 208/61; 208/68; 208/74; 208/89; 208/97

[58] Field of Search ..... 208/74, 89, 97, 59, 208/50, 72, 68, 53, 54, 61

[56] References Cited

U.S. PATENT DOCUMENTS

| | | | |
|---|---|---|---|
| Re. 28,341 | 2/1975 | Wadlinger et al. | 208/120 |
| 3,132,090 | 5/1964 | Helfrey et al. | 208/89 |
| 3,140,249 | 7/1964 | Plank et al. | 208/120 |
| 3,140,251 | 7/1964 | Plank et al. | 208/120 |
| 3,140,253 | 7/1964 | Plank et al. | 208/120 |
| 3,287,254 | 11/1966 | Patersen | 208/68 |
| 3,293,192 | 12/1966 | Maher et al. | 252/430 |
| 3,308,069 | 3/1967 | Wadlinger et al. | 252/455 |
| 3,442,795 | 5/1969 | Kerr et al. | 208/120 |
| 3,449,070 | 6/1969 | McDaniel et al. | 23/111 |
| 3,554,899 | 1/1971 | Hansford | 208/111 |
| 3,781,199 | 12/1973 | Ward | 208/89 |
| 3,816,296 | 6/1974 | Hass et al. | 208/59 |
| 3,836,454 | 9/1974 | Hansford | 208/111 |
| 3,867,277 | 2/1975 | Ward | 208/111 |
| 3,897,327 | 7/1975 | Ward | 208/111 |
| 3,923,639 | 12/1975 | Ciric | 208/111 |
| 3,923,640 | 12/1975 | Wight | 208/111 |
| 3,929,672 | 12/1975 | Ward | 252/455 Z |
| 3,972,983 | 8/1976 | Ciric | 423/328 |
| 4,016,218 | 4/1977 | Haag et al. | 260/671 R |
| 4,097,365 | 6/1978 | Ward | 208/111 |
| 4,243,519 | 1/1981 | Scherfheide | 208/210 |
| 4,257,872 | 3/1981 | LaPierre et al. | 208/59 |
| 4,302,323 | 11/1981 | Chen | 208/56 |
| 4,368,113 | 1/1983 | Winter et al. | 208/89 |
| 4,401,556 | 8/1983 | Bezman et al. | 208/111 |
| 4,404,088 | 9/1983 | Bachtel et al. | 208/59 |
| 4,426,276 | 1/1984 | Dean et al. | 208/60 |

*Primary Examiner*—Andrew H. Metz
*Assistant Examiner*—Anthony McFarlane
*Attorney, Agent, or Firm*—Alexander J. McKillop; Michael G. Gilman; Malcolm D. Keen

[57] ABSTRACT

A moderate pressure hydrocracking process is disclosed in which substantially dealkylated heavy distillate feedstocks are processed directly to high octane gasoline over a catalyst, preferably comprising a crystalline silicate zeolite hydrocracking component having a Constraint Index less than 2. The bottoms fraction produced from the contacting may be passed to an FCC unit for further processing. In another embodiment, the substantially dealkylated heavy distillate feedstock may be fractionated into a lighter boiling stream and a heavier boiling stream for better ease of processing.

23 Claims, No Drawings

PRODUCTION OF HIGH OCTANE GASOLINE

CROSS REFERENCE TO RELATED PATENT APPLICATIONS

This application is a continuation-in-part application to U.S. patent application Ser. No. 740,677, filed June 3, 1985 in the name of R. H. Fischer et al, now abandoned.

BACKGROUND OF THE INVENTION

1. Field of the Invention

The present invention relates to a catalytic hydrocracking process, and particularly to a hydrocracking process for the production of high octane gasoline and improved mid-distillates from substantially dealkylated, highly refractory, aromatic and low quality mid-distillate feedstocks. The present invention is also related to recycling upgraded fractions from the hydrocracking step to a fluid catalytic cracking unit.

2. Discussion of Prior Art

The economic viability of petroleum refineries increasingly relies on the ability to convert the greatest proportion of a given barrel of crude to premium fuels, such as gasoline, diesel and jet fuel. Catalytic cracking processes, exemplified by the fluid catalytic cracking (FCC) process and thermofor catalytic cracking (TCC) process together, account for a substantial fraction of heavy liquids conversion in modern refineries. Both are thermally severe processes, wherein the intrinsic thermal reactivity of high boiling virgin streams is of consequence. In particular, high molecular weight liquids disproportionate into relatively hydrogen rich light liquids and aromatic, hydrogen deficient heavier distillates.

Catalytic cracking in the absence of hydrogen is not an effective route to desulfurized liquids, nor is the nitrogen content of these feedstocks selectively rejected to coke. Both sulfur and nitrogen can thus concentrate appreciably in the heavier distillates derived from such primary conversion processes. Thus, these processes produce significant quantities of highly aromatic hydrogen dificient middle and heavy distillates that have high sulfur and nitrogen levels. Recycling these liquids to the catalytic cracker is often not an attractive option, because they are refractory and difficult to convert and often will impair conversion of the less refractory, nonrecycled feedstock to the catalytic cracker.

Examples of poor quality catalytic cracker refinery streams can include: light and heavy cycle oils and clarified slurry oil or main column bottoms. The following table lists two examples of such poor quality streams.

| | Aromatics | % S | ppm N | % H |
|---|---|---|---|---|
| Light Cycle Oil | 80 | 3.1 | 650 | 9.1 |
| Main Column Bottoms | G 80 | 4.6 | 1500 | 6.8 |

G = Greater Than

Today's changing market requirements make these refractory streams particularly difficult to convert to commercially valuable products. Formerly, the light and heavy cycle oils from the catalytic cracking operation could be upgraded and sold as light or heavy fuel oil, such as No. 2 fuel oil or No. 6 fuel oil. Upgrading these oils conventionally utilizes a relatively low severity operation in a low pressure catalytic desulfurization unit, where the cycle stock would be admixed with virgin mid-distillates from the same crude blend fed to the catalytic cracker. Further discussion of this conventional technology is provided in the *Oil and Gas Journal,* May 31, 1982, pp. 87–94.

Currently, the refiner is finding a diminished demand for petroleum derived fuel oil. At the same time, the impact of changes in supply and demand for petroleum has resulted in a lowering of the quality of the crudes available to the refiner; this has resulted in the formation of an even greater quantity of refractory hard-to-upgrade cycle stocks than before. As a result, the refiner is left in the position of producing increased amounts of poor quality cycle streams from the catalytic cracker while having a diminishing market in which to dispose of these streams.

An alternative market for mid-distillate streams is automotive diesel fuel. However, diesel fuel has to meet a cetane number specification of about 45 in order to operate properly in typical automotive diesel engines. As is well known in the art, cetane number correlates closely with aromatics content. Refractory cycle oils can have aromatic contents as high as 80% or even higher, resulting in cetane numbers as low as 4 or 5. In order to raise the cetane number of the cycle stock to a satisfactory level by the conventional technology disclosed earlier, substantial and uneconomic quantities of hydrogen and high pressure processing would be required.

One relatively obvious and commonly practiced alternative route to convert or upgrade these streams is to severely hydrotreat prior to recycle to the catalytic cracker, or alternatively severely hydrotreat and feed to a high pressure hydrocracker. In such cases, the object of hydrotreating is to reduce heteroatoms, e.g., sulfur and nitrogen, to very low levels while saturating polyaromatics. Although this does enhance the convertibility of aromatic streams considerably, the economic penalties derived from high hydrogen consumptions and high pressure processing are severe. In addition, in those instances where the production of gasoline is desired, the naphtha may require reforming to recover its aromatic character and meet octane specifications.

There is a substantial amount of prior art in the field of hydrocracking heavy oils over a noble metal containing zeolite catalyst. For example, U.S. Pat. No. 3,132,090 discloses the use of a two-stage hydrocracking scheme to produce high octane gasoline. However, the octane of the gasoline using a virgin distillate as charge was reported as 68 (RON+0). In the same disclosure, an octane of 80 (RON+3) was disclosed for a chargestock of coker distillate and thermally cracked gas oils. All of the "high octane" gasoline cited in the '090 patent contain 3 ml of tetraethyl lead (TEL) and are in the range of 70–88 (RON+3). TEL can add 4–6 octane numbers to gasoline; therefore, on a clear basis, these octanes are in the range of 65–83 (RON+0).

U.S. Pats. Nos. 3,554,899; 3,781,199; 3,836,454; 3,897,327; 3,929,672; and 4,097,365 disclose catalysts and processes involving the use of palladium on various forms of zeolite Y catalysts. However, these disclosures fail to see the unobvious feedstock requirement of being substantially dealkylated in order to obtain high octane gasoline.

U.S. Pats. Nos. 3,867,277 and 3,923,640 both disclose low pressure hydrocracking processes. However, the object of these disclosures is not to produce high octane gasoline, because they also fail to note the requirement to use substantially dealkylated feedstock in order to obtain high octane gasoline.

Although it is acknowledged that the above-referenced patents disclose processes which produce desirable product fuels, substantial improvements can be made in product quality in terms of higher octane number and increased cetane. It has unexpectedly been found that substantial improvements in terms of octane number and distillate quality can be made by utilizing a specific feedstock under specified conditions.

OBJECTS OF THE INVENTION

It is thus an object of the present invention to overcome the deficiencies of the prior art.

It is further an object of the present invention to provide an improved process for producing a high octane gasoline.

It is further an object of the present invention to produce a high octane gasoline using a minimum of hydrogen under pressures that are significantly lower than those used in conventional hydrocracking technology.

It is additionally an object of the present invention to produce a high octane gasoline from a feedstock comprising highly aromatic hydrogen deficient middle and heavy distillates that have high sulfur and nitrogen levels.

It is further an object of the present invention to simultaneously produce high octane naphthas that need no reforming, and mid-distillates of improved diesel properties in a low to moderate pressure operation.

These and other objects are fulfilled by the present invention, which is disclosed below.

SUMMARY OF THE INVENTION

The present invention is directed to a process for the production of a high octane gasoline, comprising contacting a substantially dealkylated feedstock with a zeolite catalyst having a Constraint Index less than 2, said contacting being conducted at hydrogen partial pressure not greater than 1000 psig, preferably 800 psig, and more preferably 600 psig, and temperatures not less than 700° F. The conversion per pass to the desired product gasoline is held to below a certain value, generally less than 50% boiling below 385° F.

The present invention is further directed to a process for the production of a high octane gasoline, having an octane number not less than 87 (RON+0), from a substantially dealkylated hydrocarbon feedstock under low pressure conditions comprising:

(a) catalytically hydrotreating the feedstock to reduce the sulfur content of the feedstock, the catalytic hydrotreating being conducted at a temperature between about 600° F. and 800° F. (315°–427° C.), hydrogen partial pressure no greater than 1000 psig, and LHSV between 0.4 and 4.0; and (b) contacting the desulfurized product of step (a) with a crystalline silicate zeolite selected from the group having the structure of faujasite, Zeolite Y, USY, UHP Y, Deal Y and REY, the contacting being conducted at a temperature between about 700° F. and 900° F. (371°–482° C.), hydrogen partial pressure no greater than 1000 psig, and LHSV between 0.4 and 4.0.

DESCRIPTION OF THE PREFERRED EMBODIMENTS

The process of the present invention is preferably arranged in a two-stage cascading relationship, whereby, in the first stage, the feedstock, as described below, is hydrotreated under moderate conditions in order to remove, or at least decrease, the sulfur content. The product of the hydrotreating stage is then passed through a hydrocracking stage at hydrogen partial pressures not exceeding 1000 psig, liquid hourly space velocity (LHSV) between 0.25 and 5.0, temperatures between 700° and 900° F., and at a conversion per pass to 385° F. (196° C.) end point gasoline less than about 50%. Without wishing to be restricted to a certain theory, it is believed that the combination of the substantially dealkylated feedstock and the moderate processing conditions offer superior reaction conditions, resulting in a gasoline having an octane number in excess of 87 (RON+0) and mid-distillates of improved properties.

It is critical to the production of high octane (at least 87 (RON+0)) gasoline that the process be operated in certain pressure-conversion regimes. It has now been discovered that gasolines of octane greater than 87 (RON+0) can be obtained at pressures as high as 1000 psig hydrogen pressure, provided conversions are limited to less than about 50% boiling below 385° F., i.e., the conversion pass to 385° F. end point gasoline is no greater than 50%.

Feedstock

Unexpectedly it has been found that in order to obtain the high octane gasoline of the present invention, the feedstock must necessarily be highly aromatic, substantially dealkylated and hydrogen deficient, such as that obtained from a catalytic cracking operation, e.g., a FCC or TCC unit. Typical feedstocks will have a hydrogen content no greater than 12.5 wt %, and API gravity no greater than 20, and an aromatic content no less than 50 wt %. Typical characteristic ranges for the feedstock are as follows:

| | |
|---|---|
| API Gravity: | 5–25 |
| Nitrogen, ppm: | 650–50 |
| Hydrogen, ppm: | 8.5–12.5 |

By way of definition of "substantially dealkylated feedstock", it is necessary to first define what is meant by an alkyl aromatic. Alkyl aromatics are generally distinguished by bulky, relatively large alkyl groups, typically but not exclusively $C_5$–$C_9$ alkyls, affixed to aromatic moieties such as, for example, benzene, naphthalene, anthracene, phenanthrene, and the like. The dealkylated product is the aromatic moiety having no side chain alkyl groups. Because of the mechanism of acidcatalyzed cracking and similar reactions, it may be assumed that prior dealkylation will remove side chains of greater than 5 carbons while leaving behind primarily methyl or ethyl groups on the aromatic moieties. Thus, for the purposes of the present invention, "substantially dealkylated" includes those aromatics with small alkyl groups, such as methyl, dimethyl and ethyl, and the like still remaining as side chains, but with relatively few large alkyl groups, i.e., the $C_5$–$C_9$ groups, remaining.

It is an additional requirement of the feedstock that the aromatic content be in excess of 50 wt %. Examples of suitable feedstocks include light cycle oils (LCO) from catalytic cracking processes. LCO generally contain about 60 to 80% aromatics and, as a result of the catalytic cracking process, are substantially dealkylated. This is because the catalytic cracking catalyst is a crystalline silicate zeolite in a silicaalumina matrix which acts to dealkylate the alkyl aromatic hydrocarbon. For example, at the temperatures employed in an FCC unit, alkyl aromatics react to form a paraffinic or olefinic chain and an aromatic ring that is substituted, if at all, with only short side chains. Other examples of suitable feedstocks include the liquid product from a delayed or fluid bed coking process. For the purpose of this disclosure, the terms "Light Cycle Oil" or "LCO" may be used to refer to the feedstock of the present invention. However, this is not to imply that only light cycle oil may be used in the present invention.

The process of the present invention will not produce high octane gasoline from predominantly virgin or straight run oils which contain aromatics and which have not been previously dealkylated by processes such as catalytic cracking or coking. If a feed is used that has not been subjected to catalytic cracking, dealkylation of the large $C_5$–$C_9$ alkyl groups will occur in a low pressure hydrocracking operation. The $C_5$–$C_9$ alkyl groups are found in the naphtha fraction and result in the formation of a relatively low octane gasoline. Smaller, i.e., $C_1$–$C_3$, alkyl side groups, if present and if dealkylated, do not appear in the naphtha boiling range, and thus do not impact on octane. If a mixture of dealkylated and non-dealkylated feedstock is used, the octane number will be intermediate between the octane numbers of the feeds used separately. It is possible that a mixture of alkylated and dealkylated feedstocks can be used with the present invention in commercial operation. In such a case, it is likely that the gasoline produced would have to be subjected to a reforming process in order to achieve the desired octane.

Catalysts

The preferred catalysts for this invention contain zeolite-type crystals and, most preferably, large pore zeolites having a Constraint Index less than 2, as described hereinafter. For purposes of this invention, the term "zeolite" is meant to represent the class of porotectosilicates, i.e., porous crystalline silicates, that contain silicon and oxygen atoms as the major components. Other components may be present in minor amounts, usually less than 14 mole %, and preferably less than 4 mole %. These components include aluminum, gallium, iron, boron and the like, with aluminum being preferred, and used herein for illustration purposes. The minor components may be present separately or in mixtures in the catalyst. They may also be present intrinsically in the structure of the catalyst.

The silica-to-alumina mole ratio referred to may be determined by conventional analysis. This ratio is meant to represent, as closely as possible, the ratio in the rigid anionic framework of the zeolite crystal and to exclude aluminum in the binder or in cationic or other forms within the channels. Although zeolites with a silica-to-alumina mole ratio of at least 10 are useful, it is preferred to use zeolites having much higher silica-to-alumina mole ratios, i.e., ratios of at least 50:1. In addition, zeolites, or otherwise characterized herein but which are substantially free of aluminum, i.e., having silica-to-alumina mole ratios up to and including infinity, are found to be useful and even preferable in some instances. The novel class of zeolites, after activation, acquire an intra-crystalline sorption affinity for normal hexane, which is greater than that for water, i.e., they exhibit "hydrophobic" properties.

A convenient measure of the extent to which a zeolite provides control to molecules of varying sizes to its internal structure is the Constraint Index of the zeolite. Zeolites which provide a highly restricted access to and egress from its internal structure have a high value for the Constraint Index, and zeolites of this kind usually have pores of small size, e.g., less than 5 Angstroms. On the other hand, zeolites which provide relatively free access to the internal zeolite structure have a low value for the Constraint Index and usually pores of large size, e.g., greater than 8 Angstroms. The method by which Constraint Index is determined is described fully in U.S. Pat. No. 4,016,218, to which reference is made for details of the method.

Constraint Index (CI) values for some typical large pore materials are:

| | CI (At Test Temperature) |
|---|---|
| ZSM-4 | 0.5 (316° C.) |
| ZSM-20 | 0.5 (371° C.) |
| TEA Mordenite | 0.4 (316° C.) |
| Mordenite | 0.5 (316° C.) |
| REY | 0.4 (316° C.) |
| Amorphous Silica-Alumina | 0.6 (538° C.) |
| Dealuminized Y (Deal Y) | 0.5 (510° C.) |
| Zeolite Beta | 0.6–2 (316°–399° C.) |

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby exhibit different Constraint Indices. Constraint Index seems to vary somewhat with severity of operation (conversion) and the presence or absence of binders. Likewise, other variables, such as crystal size of the zeolite, the presence of occluded contaminants, etc., may affect the Constraint Index. Therefore, it will be appreciated that it may be possible to so select test conditions, e.g., temperatures, as to establish more than one value for the Constraint Index of a particular zeolite. This explains the range of Constraint Indices for Zeolite Beta.

Zeolite ZSM-4 is described in U.S. Pat. No. 3,923,639, to which reference is made for details of this catalyst.

Zeolite ZSM-20 is described in U.S. Pat. No. 3,972,983, to which reference is made for details of this catalyst.

Zeolite Beta is described in U.S. Pat. Nos. 3,308,069, and Re. No. 28,341, to which reference is made for details of this catalyst.

Low sodium Ultrastable Y molecular sieve (USY) is described in U.S. Pat. Nos. 3,293,192 and 3,449,070, to which reference is made for details of this catalyst.

Dealuminized Y zeolite (Deal Y) may be prepared by the method found in U.S. Pat. No. 3,442,795, to which reference is made for details of this catalyst.

Zeolite UHP-Y is described in U.S. Pat. No. 4,401,556, to which reference is made for details of this catalyst.

The large pore zeolites, i.e., those zeolites having a Constraint Index less than 2, are well known to the art and have a pore size sufficiently large to admit the vast majority of components normally found in a feed chargestock. The zeolites are generally stated to have a pore size in excess of 7 Angstroms and are represented by zeolites having the structure of, e.g., Zeolite Beta, Zeolite Y, Ultrastable Y (USY), Dealuminized Y (Deal Y), Mordenite, ZSM-3, ZSM-4, ZSM-18, ZSM-20, and amorphous aluminosilicate. A crystalline silicate zeolite well known in the art and useful in the present invention is faujasite. The ZSM-20 zeolite resembles faujasite in certain aspects of structure, but has a notably higher silica/alumina ratio than faujasite, as does Deal Y.

Although Zeolite Beta has a Constraint Index less than 2, it is to be noted that it does not have the same structure as the other large pore zeolites, nor does it behave exactly like a large pore zeolite. However, Zeolite Beta does satisfy the requirements for a catalyst of the present invention.

The catalyst should be comprised of a source of strong acidity, i.e., an alpha value greater than 1. The alpha value, a measure of zeolite acidic functionality, is described together with details of its measurement in U.S. Pat. No. 4,016,218 and in *J. Catalysis,* Vol. VI, pages 278–287 (1966) and reference is made to these for such details. A preferred source of zeolitic acidity is a faujasite or other large pore zeolite which has low acidity (alpha between 1 and 200) due to (a) high silica/alumina ratio, (b) steaming, (c) steaming followed by dealumination, or (d) substitution of framework aluminum by other nonacidic trivalent species. Also of interest are large pore zeolites whose surface acidity has been reduced or eliminated by extraction with bulky reagents or by surface poisoning.

In practicing the process of the present invention, it may be useful to incorporate the above-described crystalline zeolites with a matrix comprising another material resistant to the temperature and other conditions employed in the process. Such matrix material is useful as a binder and imparts greater resistance to the catalyst for the severe temperature, pressure and reactant feed stream velocity conditions encountered in, for example, many cracking processes.

Useful matrix materials include both synthetic and naturally occurring substances, as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia and Florida clays or others in which the main mineral constituent is haloysite, kaolinite, dickite, nacrite or anauxite. Such clays can be used in the raw state as originally mined ro initially subjected to calcination, acid treatment or chemical modification.

In addition to the foregoing materials, the zeolites employed herein may be composited with a porous matrix material, such as alumina, silica-alumina, silica-magnesia, silica-zirconia, silica-thoria, silica-beryllia, and silica-titania, as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix, on an anhydrous basis, may vary widely with the zeolite content ranging from between about 1 to about 99 wt %, and more usually in the range of about 5 to about 80 wt % of the dry composite. It is preferable, when processing a feed containing greater than 20% 650° F.+ material, that the binding matrix itself be a material of some acidity having substantial large pore volume, i.e., not less than 100 Å.

The acidic component of the zeolite is preferably a porous crystalline zeolite. The crystalline zeolite catalysts used in the catalyst comprise a three-dimensional lattice of $SiO_4$ tetrahedra, cross-linked by the sharing of oxygen atoms and which may optionally contain other atoms in the lattice, especially aluminum in the form of $AlO_4$ tetrahedra; the zeolite will also include a sufficient cationic complement to balance the negative charge on the lattice. Acidic functionality may, of course, be varied by artifices including base-exchange, steaming or control of silica:alumina ratio.

The original cations associated with each of the crystalline silicate zeolites utilized herein may be replaced by a wide variety of other cations, according to techniques well known in the art. Typical replacing cations including hydrogen, ammonium, alkyl ammonium and metal cations, including mixtures of the same. Of the replacing metallic cations, which are discussed more fully hereinafter, particular preference is given to base metal sulfides, such as nickel-tungsten or nickel-molybdenum. These metals are believed to be advantageous in providing higher octane gasolines when operating at the higher end of the pressure regime. Other cations include metals such as rare earth metals, e.g., manganese, as well as metals of Group IIA and B of the Periodic Table, e.g., zinc, and Group VIII of the Periodic Table, e.g., platinum and palladium.

Typical ion-exchange techniques are to contact the particular zeolite with a salt of the desired replacing cation. Although a wide variety of salts can be employed, particular preference is given to chlorides, nitrates and sulfates. Representative ion-exchange techniques are disclosed in a wide variety of patents, including U.S. Pat. Nos. 3,140,249; 3,140,251; and 3,140,253.

Following contact with a solution of the desired replacing cation, the zeolite is then preferably washed with water and dried at a temperature ranging from 150° to about 600° F. (65°–315° C.), and thereafter calcined in air, or other inert gas, at temperatures ranging from about 500° to 1500° F. (260°–815° C.) for periods of time ranging from 1 to 48 hours or more. It has been further found that catalysts of improved selectivity and other beneficial properties may be obtained by subjecting the zeolite to treatment with steam at elevated temperatures ranging from 500° to 1200° F. (399°–538° C.), and preferably 750° to 1000° F. (260°–694° C.). The treatment may be accomplished in an atmosphere of 100% steam or an atmosphere consisting of steam and a gas which is substantially inert to the zeolites. A similar treatment can be accomplished at lower temperatures and elevated pressure, e.g., 350° to 700° F. (177°–371° C.) at 10 to about 200 atmospheres.

The crystalline silicate zeolite utilized in the process of this invention is desirably employed in intimate combination with one or more hydrogenation components, such as tungsten, vanadium, zinc, molybdenum, rhenium, nickel, cobalt, chromium, manganese, or a noble metal such as platinum or palladium, in an amount between 0.1 and about 25 wt %, normally 0.1 to 5 wt % especially for noble metals, and preferably 0.3 to 3 wt %. Such component can be exchanged into the composition, impregnated thereon or physically intimately admixed therewith. Such component can be impregnated into or onto the zeolite, such as, for example, in the case of platinum, by treating the zeolite with a platinum metal-containing ion. Thus, suitable platinum compounds include chloroplatinic acid, platinous chloride and various compounds containing the platinum amine complex. Phosphorus is generally also present in the fully formulated catalyst, as phosphorus is often used in solutions from which base metals, such as nickel, tungsten and molybdenum, are impregnated onto the catalyst.

The compounds of the useful platinum or other metals can be divided into compounds in which the metal is present in the cation of the compound and compounds in which it is present in the anion of the compound. Both types of compounds which contain the metal in the ionic state can be used. A solution in which platinum metals are in the form of a cation or cationic complex, e.g., $Pt(NH_3)Cl_2$, is particularly useful.

REACTION CONDITIONS

Hydrotreating Catalyst and Process

Hydrotreating is necessary to remove sulfur or nitrogen or to meet some other product specification. Hydrotreating the feed before subjecting it to hydrocracking advantageously converts many of the catalyst poisons in the hydrotreater or deposits them on the hydrotreating catalyst.

The catalyst of the first stage may be any of the known hydrotreating catalysts, many of which are available as staple articles of commerce. These are generally constituted by a metal or combination of metals having hydrogenation/dehydrogenation activity and a relatively inert refractory carrier having large pores in the general vicinity of 20 Angstrom units or more in diameter. Suitable metals are nickel, cobalt, molybdenum, vanadium, chromiun, etc., often in such combinations as cobalt-molybdenum or nickel-cobalt-molybdenum. The carrier is conveniently a wide pore alumina, silica, or silica-alumina, and may be any of the known refractories.

The hydrotreater usually operates at temperatures of 600° to 800° F. (315°–427° C.), and preferably at temperatures of 650° to 750° F. (343°–399° C.).

The hydrotreating catalyst may be disposed as a fixed, fluidized, or moving bed of catalyst, although a downflow, fixed bed operation is preferred because of its simplicity. When the hydrotreating catalyst is disposed as a fixed bed of catalyst, the liquid hourly space velocity (LHSV), i.e., the volume per hour of liquid feed measured at 20° C. per volume, of catalyst will usually be in the range of about 0.25 to 4.0, and preferably about 0.4 to 2.5. In general, higher space velocities or throughputs require higher temperature operation in the reactor to produce the same amount of hydrotreating.

The hydrotreating operation is enhanced by the presence of hydrogen, so typically hydrogen partial pressures of 200 to 1000 psig are employed, and preferably 400 to 800 psig. Hydrogen can be added to the feed on a once-through basis, with the hydrotreater effluent being passed directly to the hydrocracking reactor.

Other suitable hydrogenation components include one or more of the metals, or compounds thereof, selected from Groups II, III, IV, V, VIB, VIIB, VIII, and mixtures thereof, of the Periodic Table of Elements. Preferred metals include molybdenum, tungsten, vanadium, chromium, cobalt, titanium, iron, nickel and mixtures thereof.

Usually the hydrotreating metal component will be present on a support in an amount equal to 0.1 to 20 wt % of the support, with operation with 0.1 to 10 wt % hydrogenation metal, on an elemental basis, giving good results.

The hydrogenation components are usually disposed on a support, preferably an amorphous support such as silica, alumina, silica-alumina, etc. Any other conventional support material may also be used. It is also possible to include on the support an acid acting component, such as an acid-exchanged clay or a zeolite.

Hydrocracking

It is critical to the production of high octane gasoline that the process be operated in certain pressure-conversion regimes. The conditions of the hydrocracking stage include hydrogen partial pressures as high as 1000 psig, provided that the feedstock conversion to product gasoline per pass is limited to a certain level, generally less than 50% boiling below 385° F. At pressures of about 1000 psig, conversions of greater than 50% can be attained if the process is operated at low space velocities. However, such high conversions result in less desired lower gasoline octane numbers. A preferred hydrogen partial pressure is 800 psig, with 600 psig being more preferred. The pressure may be maintained at the level prevalent in the hydrotreater, or even reduced to a lower level. However, in general, for full range light cycle oil, the pressure should be maintained such that conversion to 385° F. wt % liquid will equal or be less than 0.05 times the hydrogen partial pressure. The ratio of LHSV from the first stage to the second stage reactor is between about 0.25 and 2.5, and preferably between 0.5 and 1.5. Temperatures in this stage need to be high; preferably, they are maintained about 700° F. (371° C.), up to a maximum of 900° F. (482° C.). The precise temperature requirement is critically dependent upon the nature of the feeds being processed.

By cascade operation, it is meant that at least about 90%, and preferably all, of the material processed in the first stage of the reactor is processed in the second stage. Optionally, there can be an intermediate separation or cooling of the fluid going from one reaction zone to the next. In its simplest form, a cascade operation may be achieved by using a large downflow reactor, wherein the lower portion contains the catalyst comprising the zeolite described previously and the upper portion contains the hydrotreating catalyst.

Recycling the Feedstock

Another embodiment of the present invention is directed to low pressure hydrocracking of the highly aromatic, substantially dealkylated feedstock, as disclosed previously, to produce the desired high octane gasoline and at least an unconverted bottom fraction, followed by the recycle of the unconverted, yet upgraded, bottom fraction from the hydrocracking step to a catalytic cracking unit, such as an FCC or TCC unit. The FCC and TCC processes are well known to the art, and a detailed description thereof is not believed necessary. Although the design and construction of the individual plants may vary, the essential elements of an FCC unit are illustrated in U.S. Pat. No. 4,368,114, which is incorporated herein by reference. The FCC unit will be used for purposes of describing this embodiment of the invention.

This embodiment consists of recycling an unconverted fraction from the low pressure hydrocracking back to the FCC unit, resulting in the formation of substantially more high octane gasoline.

At typical petroleum refineries, a substantially dealkylated feedstock, e.g., LCO, from the FCC unit is a significant component of the feed to the catalytic hydrodesulfurization (CHD) unit which produces No. 2 fuel oil or diesel fuel. The remaining component is generally virgin kerosene taken directly from the crude distillation unit. The highly aromatic nature of LCO, particularly that derived from the operation of the FCC unit in maximum gasoline mode, increases operational difficulties for the CHD and can result in a product having marginal properties of No. 2 fuel oil or diesel oil, as measured by cetane numbers and sulfur content. Cetane number corresponds to the percent of pure cetane in a blend of alphamethylnaphthalene which matches the ignition quality of a diesel fuel sample. This quantity, when specified for middle distillate fuels, is synonymous with the octane number of gasolines.

As a result, FCC recycle of untreated light cycle oil has been observed as a method for reducing the amount of LCO. Key benefits expected from the recycle of LCO include conversion of LCO to gasoline, backout of kerosene from No. 2 fuel oil and the kerosene pool, and diminished use of cetane improver. However, in most cases, these advantages are outweighed by disadvantages, which include increased coke made in the FCC unit, diminished quality of the resultant LCO and an increase in heavy cycle oil and gas.

A typical LCO is such a refractory stock and of poor quality relative to a fresh FCC feed that most refineries do not practice recycle to a significant extent. One relatively obvious and commonly practiced alternative route to convert or upgrade these streams is to severely hydrotreat prior to recycle to the catalytic cracker or, alternatively, severely hydrotreat and feed to a high pressure hydrocracker. In such cases, the object of hydrotreating is to reduce heteroatoms, e.g., sulfur and nitrogen, to very low levels while saturating polyaromatics. Although this does enhance the convertibility of aromatic streams considerably, the economic penalties derived from high hydrogen consumptions and high pressure processing are severe. In addition, in those instances where the production of gasoline is desired, the naphtha may require reforming to recover its aromatic character and meet octane specifications. However, by combining low pressure hydrocracking of LCO with recycle of the unconverted portion of the FCC unit, considerable improvement is possible in conversion gasoline yields and gasoline octane values.

In its preferred embodiments, a highly aromatic, substantially dealkylated feedstock, as defined previously, is first hydrotreated at moderate pressures and space velocities only sufficient to reduce sulfur to specification levels. Temperatures in this pretreatment operation are restricted by conventional considerations, such as catalyst stability, to about 800° F. (427° C.). Products from this pretreatment can be cascaded directly without any interstage separation into the hydrocracking stage containing the catalyst described previously. Pressures at this stage are kept at or below 100 psig and, as described previously, are coordinated with a specific conversion regime. The pressure may be maintained at a level prevalent in the hydrotreater, consistent with the 1000 psig maximum, or even reduced to a lower level. LHSV's in the aromatic conversion stage may vary in the range of 0.25 to 5.0. Temperatures in this stage should be high, preferably above 700°, up to a maximum of 900° F. (371°–482° C.). The precise temperature requirement is critically dependent on the nature of the feeds being processed. Either a portion or the entire unconverted stream produced from the low pressure hydrocracking unit is then stripped of gases and distilled. Part or all of the treated 385° F.+ LCO is then fed to an FCC unit along with the fresh feedstock, such as sour heavy gas oil (SHGO). The FCC feed is cracked and distilled, thus producing additional substantially dealkylated distillate for the cycle process.

The process combination of low pressure hydrocracking and fluid catalystic cracking unexpectedly provides more gasoline at higher octane than either recycle of untreated LCO or recycle of conventionally hydrofined LCO. In addition, when compared to conventional hydrofining more gasoline at higher octane is produced at lower hydrogen consumption. This process combination embodies both recycle of the entire unconverted stream from the low pressure hydrocracking of LCO, or any part thereof. In any of these embodiments, the low pressure hydrocracking-FCC combination is superior to that of recycling untreated or conventionally hydrofined LCO.

Fractionating the Feedstock

In still another embodiment, it has been found that by fractionating LCO into heavy and light streams and subjecting the lighter, lower boiling stream to low pressure hydrocracking and the heavier, high boiling stream to conventional catalytic hydrodesulfurization, more gasoline at higher octane at an overall higher space velocity can be produced than by low pressure hydrocracking of the full range material.

In its preferred embodiment, a full range 385° to 750° F. (196°–399° C.) LCO is fractionated into a light stream and a heavy stream; the light stream still remains a highly aromatic (greater than 50% aromatic by silica gel separation) feedstock. This light stream is first hydrotreated at moderate pressures and space velocities only sufficient to reduce sulfur to specification levels. Temperatures in this pretreatment operation are restricted by conventional considerations, such as catalyst stability, to below 800° F. (427° C.). Products from this pretreatment can be cascaded directly without any interstage separation into the hydrocracking stage containing the catalyst of the above description. Pressures in this stage should not exceed 1000 psig. The pressure may be maintained at the level prevalent in the hydrotreater, consistent with the 1000 psig maximum, or even reduced to a lower level. LHSV's in the aromatic conversion stage may vary in the range 0.25 to 5.0. Temperatures in this stage need to be high; preferably, they are maintained above 700°, up to a maximum of 900° F. (371°–482° C.). The precise temperature requirement is critically dependent on the nature of the feeds being processed.

The heavy stream is subjected to a standard hydrotreatment process similar to that employed in the first stage of the low pressure hydrocracking operation. It can be hydrotreated either as is, or admixed with virgin straight run light gas oils, or other similar refinery streams familiar to those skilled in the art. This hydrotreated material from the heavy stream can then be mixed with the unconverted portion of the light stream, resulting in a distillate useful as a fuel oil or diesel fuel. Alternatively, the material from the heavy stream and/or the unconverted material from the light stream can be recycled to the FCC, as previously disclosed.

This process demonstrates, unexpectedly, that fractionating light cycle oil into a lower boiling stream which is subjected to the low pressure hydrocracking process, and a higher boiling stream which is subjected to conventional catalytic hydrodesulfurization (CHD) processing, results in more gasoline at higher octane with lower hydrogen consumption than low pressure hydrocracking of the entire LCO. A crucial aspect is that the feedstock be substantially dealkylated, such as that obtained from catalytic cracking cycle oils. The proposed process may also be used to remove, with or without boiling range conversion, the nitrogen present in the distillate and gas oil fractions, which may then be recycled to FCC for further conversion. The proposed hydrocracking process and catalyst may also be employed, at reduced severities to render distillates suitable for use as diesel fuel, by removal of the aromatics therefrom.

The present invention will now be illustrated by examples, which are not intended to limit the scope of the present application.

EXAMPLES

In the examples, the dealkylated chargestock was a Light Cycle Oil (LCO) having the properties listed below. The comparative non-dealkylated feedstock was catalytic hydrodesulfurization feed (CHD) having properties also listed below.

| | LCO | CHD |
|---|---|---|
| Gravity, API | 11 | 29 |
| Sulfur, Wt % | 3.1 | 1.65 |
| Hydrogen, Wt % | 9.1 | 12.0 |
| Nitrogen, ppm | 650 | 320 |
| Diesel Index | 4.3 | 31 |

EXAMPLE 1

Example 1 is designed to show the octane improvement in a product gasoline by passing a dealkylated feedstock (LCO) over a large pore zeolite catalyst under conditions including a pressure of 600 psig. LCO was charged to a two-reactor catalyst system operating in the cascade mode. The catalyst in the first reactor or hydrotreating stage was a NiMo/alumina hydrotreating catalyst ($NiMo/Al_2O_3$). The second stage catalyst was selected from the following group:

(1) 0.35% palladium impregnated on rare earth-exchanged Y zeolite (0.35% Pd/REY);

(2) 3% palladium on an extensively dealuminized Y zeolite (3% Pd/Deal Y); and (3) 1% palladium on Ultrastable Y zeolite (1% Pd/USY).

The Y-type catalysts of the present invention were typically prepared by extruding a mixture of about 50 to 80 wt %, preferably 60 to 75 wt %, large pore zeolite ($SiO_2/Al_2O_3$ mole ratio of 5.25), and about 20 to 50 wt %, preferably 25 to 40 wt % of a binder such as, for example, alumina. Upon drying (250° F., overnight) and calcination (1000° F., 3 hours), the resulting extrudates underwent repeated $NH_4NO_3$ exchanges to reduce the sodium content. Sodium removal was enhanced by intermediate calcinations (1000° F., 3 hours) in dry air. Typically, the alpha activity of the extrudates increased from 5 to 10 to greater than 200 after the exchange-calcination procedure. To increase the $SiO_2Al_2O_3$ ratio of the zeolite framework, the catalyst was steamed (1000° F., 8 hours, 1 atm steam); the alpha activity was reduced to 50. Typically, 1 to 3 wt % of palladium, in the form of palladium tetraammine chloride, was incorporated into the steamed bound Y catalyst via ion-exchange. The ion-exchanged catalyst was then calcined at 660° F. for 3 hours.

The procedure of Example 1 was followed under conditions specified in Table 1, which also recites the results:

TABLE 1

| Catalyst | .35% Pd/REY | 3% Pd/DealY | 1% Pd/USY | .35% Pd/REY |
|---|---|---|---|---|
| Feedstock | LCO | LCD | LCD | CHD |
| Temperature, °F. | | | | |
| First Reactor | 675 | 675 | 675 | 675 |
| Second Reactor | 775 | 775 | 725 | 775 |
| LHSV, Overall | .5 | 1 | 1 | 1 |
| $C_5$-385° F., % | 20 | 14 | 16 | 10 |
| Octane, RON + O | 94.6 | 95.0 | 93.5 | 74 |
| $H_2$ Consumption, SCF/B | 1270 | 800 | 1160 | 635 |
| Inlet $H_2$ Pressure, psig | 600 | 600 | 600 | 600 |

It can be seen from Table 1 that 14 to 20 wt % (18–25 vol %) of the LCO chargestock is converted to high octane gasoline. This can be compared to the non-dealkylated CHD feedstock comprised primarily of virgin mid-distillate, where a low octane gasoline, i.e., 74 (RON+0) is produced. These results show the invention does not produce a high octane gasoline from a stock comprised primarily of virgin mid-distillates.

EXAMPLE 2

Example 2 illustrates the effect of different pressure conditions on the octane number of the product gasolines. The procedure of Example 1 was followed under the conditions specified in Table 2, which also illustrates the results:

TA8LE 2

| Catalyst | 3% Pd/DealY | 3% Pd/DealY |
|---|---|---|
| Temperature, °F. | | |
| First Reactor | 675 | 675 |
| Second Reactor | 775 | 725 |
| LHSV, Overall | 1 | 1 |
| Inlet $H_2$ Pressure, psig | 600 | 1000 |
| $C_5$-385° F., % | 14 | 26 |
| Octane, RON + O | 95.0 | 87.0 |
| $H_2$ Consumption, SCF/B | 870 | 1930 |

As illustrated in Table 2, the operation at an inlet hydrogen partial pressure of 1000 psig gave a slightly larger conversion to gasoline, but the gasoline had a lower octane number than the operation run at an inlet hydrogen partial pressure of 600 psig.

EXAMPLE 3

Example 3 compares the results of the preferred two-stage cascade reactor system of the present invention, as described in Example 1, with the hydrotreating (HDT) process alone. The catalysts used for the present invention were $NiMo/Al_2O_3$ (first stage) and 0.35% Pd/REY (second stage). The basic procedure of Example 1 was followed under conditions specified in Table 3, which also specifies the results:

TABLE 3

| | HDT Alone | Present Invention |
|---|---|---|
| Temperature, °F. | | |
| First Reactor | 725 | 675 |
| Second Reactor | — | 775 |
| Inlet $H_2$ Pressure, psig | 600 | 600 |
| 330°–650° F. Properties | | |
| Aniline Pt* | 26 | 29 |
| Diesel Index** | 5.5 | 6.3 |

TABLE 3-continued

| | HDT Alone | Present Invention |
|---|---|---|
| $H_2$ Consumption, SCF/B | 1300 | 800 |

*Aniline Pt is a measure of the aromatic content of petroleum products.
**Diesel Index is a measure of distillate quality and correlates with cetane number. Diesel Index is calculated from the aniline point and specific gravity.

It can be seen from Table 3 that the present invention improves the Diesel Index of the unconverted mid-distillate more than simple hydrotreatment, yet consumes a great deal less in hydrogen. The end result is high octane gasoline plus improved distillate with lower hydrogen consumption than hydrotreatment alone.

EXAMPLE 4

Example 4 illustrates the advantages of a combination low pressure hydrocracking/FCC process utilizing LCO. Example 4 was carried out using a highly aromatic and hydrogen deficient LCO obtained from a commercial fluid catalytic cracking unit during maximum gasoline mode operation. Table 4 gives properties of the LCO, as well as sour heavy gas oil (SHGO):

TABLE 4

| | LCO | SHGO |
|---|---|---|
| Gravity, °API | 11.0 | 21.9 |
| Sulfur, Wt % | 3.1 | 2.4 |
| Hydrogen, Wt % | 9.1 | 12.5 |
| Nitrogen, ppm | 650 | 700 |
| Diesel Index | 3.0 | — |
| Aromatics, Wt % | 80 | 53 |
| Monoaromatics, Wt % | 10 | 18 |
| Diaromatics, Wt % | 42 | 15 |
| Triaromatics, Wt % | 13 | 6 |
| Benzo and Dibenzo Thiophenes, Wt % | 15 | 7 |
| Other Aromatics, Wt % | 0 | 7 |

The LCO contained 80% aromatics and had a hydrogen content of 9.1%. As a result of its very low cetane quality (cetane index of 21.6 and a diesel index of 3.0), it would require blending with about 60% virgin kerosene followed by CHD treating in order to make a marketable quality No. 2 fuel oil. The LCO was hydrotreated at 600 psig hydrogen pressure over a conventional $NiMo/Al_2O_3$ catalyst, resulting in 1100 SCF/bbl hydrogen consumption. Table 5 gives process conditions for preparing the hydrotreated LCO, as well as the product properties:

TABLE 5

Preparation and Properties of LCO Stocks*

| Catalyst | Hydrotreated LCO $NiMo/Al_2O_3$ | Low Press HC LCO $NiMo/Al_2O_3$ Pd/Deal Y |
|---|---|---|
| Operating Conditions | | |
| Temperature, °F. | 650 | 675/775 |
| Pressure, psig | 600 | 600 |
| LHSV, Overall | .9 | 1.0 |
| $H_2$ Circ., SCF/bbl | 9400 | 8300 |
| Hydrogen Consumption, SCF/bbl | 1100 | 870 |
| $C_5$+ Yield (Wt %, Vol %) | 101.7/104.5 | 101.3/104.3 |
| TLP Properties | | |
| API Gravity | 22 | 21.1 |
| Sulfur, % | .25 | .33 |
| Desulfurization, % | 92.1 | 89.8 |
| Nitrogen, ppm | 120 | 120 |
| Denitrogenation, % | 61 | 82 |
| Hydrogen, % | 11.17 | 10.33 |
| $C_5$-385° F. (Wt %, Vol %) | 3 | 14.5/17.3 |
| RON + O | | 95.0 |
| 385° F.+ (Wt %, Vol %) | 97 | 81.6/87.2 |
| API | | 20.5 |

TABLE 5-continued

Preparation and Properties of LCO Stocks*

| Catalyst | Hydrotreated LCO $NiMo/Al_2O_3$ | Low Press HC LCO $NiMo/Al_2O_3$ Pd/Deal Y |
|---|---|---|
| Aniline Pt. | | 39 |
| Sulfur, % | | .27 |
| Hydrogen, % | | 10.38 |
| Diesel Index | | 8.0 |

*Entire Untreated and HDT LCO cracked in FCC 385° F.+ LPHC cracked in FCC

Little hydrogen gas was formed and a negligible amount of conversion to 385° F.− occurred; the hydrogen was consumed in heteroatom removal and aromatics saturation. The diesel index of the hydrotreated LCO is 6.9 versus the 3.0 of the untreated LCO. This is consistent with prior observations that ignition quality, as measured by diesel index or cetane index, is relatively insensitive to hydrogen consumption (see, for example, *Oil and Gas Journal,* May 31, 1982, pp. 87–94).

The prior examples showed that LCO can be converted to high octane gasoline and improved distillate at low pressure and hydrogen consumption. In Example 4, LCO was subjected to cascade low pressure hydrocracking at 600 psig hydrogen pressure over a $NiMo/Al_2O_3$, palladium on dealuminized Y catalyst system, resulting in formation of 17 vol %, 95 RON gasoline ($C_5$—385° F.) at 870 SCF/bbl hydrogen consumption. Table 5 gives the process conditions for the low pressure hydrocracking operation, as well as product properties. The unconverted distillate was 87 vol % on charge and had a diesel index of 8.0. The hydrogen content of the unconverted distillate was 10.4%, significantly lower than the 11.2% hydrogen content material obtained from conventional hydrotreating. The acid catalyzed low pressure hydrocracking (LPHC) process renders the unconverted 385° F.+ liquids lower in nitrogen than the conventionally hydrotreated LCO.

Prior to catalytic cracking, the hydrotreated LCO liquid product was stripped of gases, while the liquid product from low pressure hydrocracking was distilled to remove the $C_5$—385° F. gasoline. A 20 wt % mixture of either untreated, hydrotreated or low pressure hydrocracked 385° F.+LCO and 80 wt % sour heavy gas oil was charged to a fixed-fluidized bed laboratory scale FCC unit. Detailed properties of the sour heavy gas oil are provided in Table 4. Catalytic cracking was carried out using a commercial FCC equilibrium catalyst at 960° F., and 1.0 minute oil on-stream. FCC catalyst properties and FCC results are provided in Tables 6 and 7, respectively.

TABLE 6

Chemical Composition and Physical Properties of Equilibrium FCC Catalyst

| | |
|---|---|
| Chemical Composition | |
| $SiO_2$, % | 61.5 |
| $Al_2O_3$, % | 31.2 |
| $RE_2O_3$, % | 3.9 |
| Ni, ppm | 1905 |
| V, ppm | 4000 |
| Physical Properties | |
| Real Density, g/cc | 2.59 |
| Particle Density, g/cc | 1.44 |
| Pore Volume, cc/g* | 0.31 |
| Surface Area, $m^2/g$ | 76 |

TABLE 6-continued

| Chemical Composition and Physical Properties of Equilibrium FCC Catalyst | |
|---|---|
| Packed Density, g/cc | 0.98 |

*Calculated from Real Density and Particle Density

Assuming linear blending of the octanes, Table 7 shows the octane is significantly higher from the LPHC/FCC route than from the HDT/FCC route. The LPHC/FCC route produces more gasoline with a higher octane at lower hydrogen consumption than the HDT/FCC combination.

TABLE 7

| Incremental FCC Yields From LCO Based on Constant Conversion | Sour Heavy Gas Oil | 20% LCO + 80% SHGO | 20% HDT/LCO + 80% SHGO | 20% LPHC/LCO + 80% SHGO |
|---|---|---|---|---|
| Conversion, Vol % | 60 | 60 | 60 | 60 |
| $C_5$+ Gasoline, Vol % | 49.8 | 44.5 | 47.6 | 46.2 |
| Total $C_4$, Vol % | 13.3 | 12.9 | 13.0 | 12.5 |
| Dry Gas, Wt % | 6.1 | 7.5 | 6.5 | 7.0 |
| Coke, Wt % | 2.9 | 5.3 | 3.5 | 4.1 |
| RON + O, $C_5$+ Gasoline | 89.3 | 90.1 | 89.4 | 89.9 |
| LFO, Wt % | 31.1 | 36.7 | 36.1 | 36.1 |
| HFO, Wt % | 11.0 | 6.5 | 6.9 | 6.9 |
| Incremental Yields | | | | |
| Conversion, Vol % | 0 | 60 | 60 | 60 |
| $C_5$+ Gasoline, Vol % | 0 | 23.3 | 38.8 | 31.8 |
| RON + O | — | 93.3 | 89.8 | 92.3 |
| Coke, Wt % | 0 | 14.9 | 5.9 | 8.9 |
| Vol Fraction to FCC | — | 1 | 1 | .87 |
| Gasoline from Hydro-Processing, Vol % | — | 0 | 0 | 17.3 |
| RON + O | | — | — | 95 |
| Total Gasoline from LCO | — | 23.3 | 38.8 | 45.0 |
| RON + O | — | 93.3 | 89.8 | 93.3 |

The results shown for LCO are the incremental yields backed out by comparing the cracking data of the blends with that from the sour point gas oil alone. The expression used to calculate these yields is as follows:

INCREMENTAL CRACKING YIELDS

Calculation assumes linear addition of yields for sour heavy gas oil and incremental component:

$$\text{Yield [Mix]} = (X[LCO])(\text{Yield}[LCO]) + (X[SHGO])(\text{Yield}[SHGO]) \quad (1)$$

*LCO* = Untreated, *HDT*, or 385° F. + *LPHC* Light Cycle Oil

*LPHC* = Low Pressure Hydrocracking

*X* = Fraction in Feed

*SHGO* = Sour Heavy Gas Oil

Incremental yield of *LCO*

$$\text{Yield}[LCO] = \frac{\text{Yield[Mix]} - (X[SHGO])(\text{Yield}[SHGO])}{X[LCO]} \quad (2)$$

The overall objective of this example was to compare the crackability of untreated LCO with that of the hydrotreated LCO, as well as the unconverted LCO, from low pressure hydrocracking. Low crackability and an increase in coke make are expected when a highly aromatic LCO is recycled to the FCC. Table 7 shows the cracking data for an equal 60% conversion basis of each blend, as well as for the heavy sour gas oil base materail. On an incremental yield basis, 23.3 vol % of $C_5$+gasoline was formed from the untreated LCO, while 38.8 vol % was formed from the hydrotreated LCO, and 31.8 vol % resulted from the low pressure hydrocracked material. Adjusting the FCC yields by the volume fraction to be sent to the FCC and adding the gasoline formed during the LPHC operation, a total of 45 vol % gasoline is formed from the LPHC/FCC combination.

EXAMPLE 5

This example illustrates the benefits of fractionating the LCO feedstock prior to low pressure hydrocracking. Table 8 provides properties of various cuts of LCO processed:

TABLE 8

| LCO Cut | 385°-725° F. (Full Range) | 385°-550° F. (550° F.−) | 385°-640° F. (640° F.−) | 550°-725° F. (550° F.+) |
|---|---|---|---|---|
| Wt % of LCO | 100 | 42 | 70 | 58 |
| Gravity, API | 11 | 15.9 | 15.0 | 6.9 |
| Sulfur, % | 3.1 | 2.97 | 2.88 | 3.39 |
| Hydrogen, % | 9.1 | 9.33 | 9.38 | 8.21 |
| Nitrogen, ppm | 650 | 60 | 140 | 1000 |
| Aromatics, % | 80 | — | 72 | 83 |

The various cuts of LCO shown in Table 8 were charged to a two reactor catalyst system operating in the cascade mode. The first catalyst consisted of a conventional $NiMo/Al_2O_3$ hydrotreating catalyst. The second catalyst was 1 to 3% palladium impregnated on dealuminized zeolite Y. Results from these operations are shown in Table 9:

TABLE 9

| Conversion of LCO | Full Range | 550° F.− | 640° F.− | 550° F.+ |
|---|---|---|---|---|
| Gasoline, Vol % | 17 | 45 | 35 | 12 |
| RON + O | 95 | 98 | 97 | 92 |
| Second Stage LHSV | 2 | 3 | 2 | 1 |

As can be seen from this Table, the 550° F.− and 640° F.− fractions converted substantially more than the full range material, which in turn converted more than the 550° F.+ LCO. In addition, octane numbers of the gasoline from the 550° F.− and 640° F. fractions were higher.

Note, from Table 9, the second stage LHSV was higher for the lower boiling fractions, yet conversions were also higher. Thus, it has been found unexpectedly that low pressure hydrocracking of fractionated LCO produced more gasoline at higher octane using a higher LHSV than the full range LCO.

Commercially, this process concept would involve fractionation of the LCO into a higher boiling fraction, with a 5% point ranging from 550°–700° F., hydrotreatment of the higher boiling fraction, and low pressure hydrocracking of the lower boiling fraction. Hydrotreating of the higher boiling fraction would proceed by charging the higher boiling LCO fraction alone, or as a mixture of the LCO with a virgin kerosene stream, to a catalytic desulfurization (CHD) unit. Table 10 shows results of such an operation, compared to LPHC of a full range LCO:

TABLE 10

| Full Range vs. Split Stream LPHC | | |
|---|---|---|
| Feed | Full Range | Fractionated at 550° F. |
| Overall LHSV | 0.5 | 1.7 |
| Hydrogen Consumption | 1200 | 1160 |
| Product, Vol % | | |
| $C_4$'s | 2.4 | 3.7 |
| $C_5$—385° F. | 20 | 21 |
| RON | 94 | 98 |
| 385° F. Distillate | 84 | 82 |
| Diesel Index | 8.6 | 10.9 |

Table 10 shows that split stream LPHC produces more gasoline at higher octane and higher space velocity than full range LPHC. In addition, the unconverted 385° F.+ distillate is of better quality, as measured by diesel index.

It can thus be seen that in contrast to earlier approaches, which attempted to saturate and eliminate aromatics prior to conversion, the present invention has been able to selectively extract the most aromatic constituents of the feedstocks, advantageously using a minimum of hydrogen under pressures that are significantly lower than those used in conventional hydrocracking technology. Naphthas of an unexpectedly high octane, i.e., greater than 87 (RON+0), and in a preferred embodiment greater than 90 (RON+0), that are directly blendable into gasoline pools can be produced. The remaining unconverted products in the higher boiling liquids are less aromatic and make better candidate feedstocks for automotive diesel fuel, because the process selectively removes a significant portion of the aromatics in the parent material and, in addition, by forming gasoline, has reduced the amount of cycle oil remaining. Thus, the process achieves conversion with a selectivity that matches hydrocarbon type to product specification, i.e., aromatic high octane naphthas and more paraffinic higher cetane distillates, are produced. Alternatively, unconverted cycle oil will have been improved as FCC feed because of the lower nitrogen and aromatic content.

In light of the current efforts to enhance the yield of premium liquid products from each barrel of crude charged to a refinery, it can be anticipated that the production of low quality, refractory and aromatic liquids from coking and FCC processes will increase. Processing, such as that described herein, will allow the upgrading of such streams in the most hydrogen efficient fashion, without the use of expensive high pressure processing.

Further, the low pressure hydrocracking scheme, in combination with FCC, could add considerable flexibility to the upgrading and marketing of mid-distillates in U.S. refineries, while improving overall gasoline yield and octane. High octane gasoline is produced directly by the LPHC process scheme and, as disclosed previously, the unconverted LCO from LPHC is an improved mid-distillate suitable for the No. 2 fuel oil or diesel pool. Alternatively, a portion or all of this material can be recycled to the FCC where it produces additional high octane gasoline. As a result of conversion of the LCO to gasoline, both directly by LPHC and by FCC recyle of the unconverted LCO, kerosene can be backed out of the No. 2 fuel oil pool, thereby permitting expansion in the jet fuel or No. 1 fuel oil market. In addition, savings could be realized by backing out cetane improver. This process combination results in the upgrading of a refractory stream, such as light cycle oil, in a hydrogen efficient fashion without the use of expensive high pressure processing.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A process for the production of high octane gasoline having an octane number not less than 87 (RON+0), comprising contacting a substantially dealkylated feedstock with a crystalline silicate zeolite having a Constraint Index less than 2, said substantially dealkylated feedstock containing not less than 50 vol % aromatic content and not greater than 12.5 wt % hydrogen content, said contacting being conducted at hydrogen partial pressure not greater than 1000 psig, temperatures not less than 700° F., and a percentage conversion per pass to 385° F. end point gasoline not greater than 50%, wherein said percentage conversion per pass is numerically no greater than 0.05 times the hydrogen partial pressure.

2. The process according to claim 1, wherein said contacting is conducted at total pressures not greater than 800 psig.

3. The process according to claim 1, wherein said contacting is conducted at total pressures not greater than 600 psig.

4. The process according to claim 1, wherein said zeolite is selected from the group consisting of the structures of Mordenite, faujasite, Zeolite Y, ZSM-3, ZSM-4, ZSM-18, ZSM-20 and Zeolite Beta.

5. The process according to claim 4, wherein said zeolite has an alpha value not less than 1.

6. The process according to claim 5, wherein said zeolite comprises at least one hydrogenation component selected from the group consisting of tungsten, vanadium, zinc, molybdenum, rhenium, nickel, cobalt, chromium, manganese, platinum, palladium and mixtures thereof.

7. The process according to claim 5, wherein said zeolite comprises between 0.1 and 25 wt % of at least one hydrogenation component selected from the group consisting of mixtures of nickel/tungsten, mixtures of nickel/molybdenum, and mixtures of cobalt/molybdenum.

8. The process according to claim 1, wherein said substantially dealkylated feedstock is selected from the group consisting of light cycle oils from catalytic cracking, liquid products from a delayed coking process, and liquid products from a fluid bed coking process.

9. The process according to claim 1, wherein said substantially dealkylated feedstock is light cycle oil.

10. The process according to claim 1, wherein said substantially dealkylated feedstock further comprises an API gravity between 5 and 25, a nitrogen content between 50 and 650 ppm, and a hydrogen content between 8.5 and 12.5 wt %.

11. The process according to claim 1, wherein said contacting is conducted at LHSV between 0.25 and 2.5.

12. The process according to claim 1, further comprising hydrotreating said substantially dealkylated feedstock prior to said contacting with said zeolite under hydrotreating conditions sufficient to remove at least a portion of the sulfur and nitrogen compounds from said feedstock.

13. The process according to claim 12, wherein said hydrotreating catalyst comprises a hydrogenation/-dehydrogenation metal on a support and said hydrotreating conditions include a pressure not greater than 1200 psig, LHSV between 0.25 and 5, and temperatures between 600° and 800° F.

14. The process according to claim 1, further comprising passing the unconverted, upgraded bottom fraction resulting from contacting said substantially dealkylated feedstock with said crystalline silicate zeolite to a fluid catalytic cracking unit.

15. The process according to claim 14, wherein said unconverted, upgraded bottom fraction is stripped of gases and distilled prior to passing to said fluid catalytic cracking unit.

16. The process according to claim 14, wherein said unconverted, upgraded bottom fraction is 385° F.+ light cycle oil.

17. The process according to claim 1, wherein, prior to contacting with said zeolite, said substantially dealkylated feedstock is fractionated into a heavy higher boiling stream and a lighter lower boiling stream, wherein said lighter lower boiling stream is contacted with a hydrotreating catalyst comprising a hydrogenation/dehydrogenation metal on a support, under hydrotreating conditions, including a pressure not greater than 1200 psig, LHSV between 0.25 and 5, and temperture between 600° and 800° F. to produce a hydrotreated product.

18. The process according to claim 17, wherein said heavy higher boiling stream is admixed with a virgin straight run light gas oil and hydrotreated with a hydrotreating catalyst comprising a hydrogenation/dehydrogenation metal on a support, said hydrotreating conditions including a pressure not greater than 1200 psig, LHSV between 0.25 and 5, and temperature between 600° and 800° F., said hydrotreated heavy higher boiling stream further being admixed with the unconverted portion of said lighter lower boiling stream.

19. The process according to claim 18, wherein said mixture of said hydrotreated heavy higher boiling stream and said unconverted portion of said lighter lower boiling stream is passed to an FCC unit.

20. A process for the production of a high octane gasoline, having an octane number not less than 87 (RON+0), from a substantially dealkylated hydrocarbn feedstock comprising not less than 50 vol % aromatic content, an API gravity between 5 and 25, a nitrogen content between 50 and 650 ppm, and a hydrogen content between 8.9 and 12.5 wt %, comprising:

hydrotreating said substantially dealkylated feedstock in the presence of a hydrotreating catalyst comprising a hydrogenation/dehydrogenation metal on a support, under hydrotreating conditions, including a pressure not greater than 1200 psig, LHSV between 0.25 and 5, and temperature between 600° and 800° F.;

contacting said hydrotreated substantially dealkylated feedstock with a crystalline silicate zeolite having a Constraint Index less than 2, said contacting being conducted at hydrogen partial pressure between 600 and 1000 psi, temperatures not less than 700° F., LHSV between 0.25 and 2.5, and a conversion per pass to 385° F. end point gasoline no greater than 50% to form a product comprising a 385° F. end point gasoline and an unconverted, upgraded bottom fraction; and passing said unconverted, upgraded bottom fraction to an FCC unit for further processing.

21. The process according to claim 20, wherein said unconverted, upgraded stream is 385° F.+ light cycle oil.

22. The process according to claim 20, wherein said substantially dealkylated feedstock is a product of said FCC unit, such that said process is a cyclic process.

23. The process according to claim 1, wherein said contacting is conducted at a hydrogen partial pressure not less than 600 psig.

* * * * *